US011940162B2

(12) United States Patent
Kil et al.

(10) Patent No.: US 11,940,162 B2
(45) **Date of Patent: *Mar. 26, 2024**

(54) INTEGRATED AIR CONDITIONER

(71) Applicant: Samsung Electronics Co., Ltd., Suwon-si (KR)

(72) Inventors: Yong Hyun Kil, Suwon-si (KR); Jung Ho Kim, Suwon-si (KR); Joon Ho Yoon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/530,253

(22) Filed: Nov. 18, 2021

(65) Prior Publication Data

US 2022/0074606 A1 Mar. 10, 2022

Related U.S. Application Data

(63) Continuation of application No. 17/008,285, filed on Aug. 31, 2020, now Pat. No. 11,204,180, which is a (Continued)

(51) Int. Cl.
*F24F 1/022* (2019.01)
*F24F 1/00* (2019.01)
(Continued)

(52) U.S. Cl.
CPC ..... *F24F 1/022* (2013.01); *F24F 1/00* (2013.01); *F24F 1/0323* (2019.02); *F24F 1/04* (2013.01);
(Continued)

(58) Field of Classification Search
CPC .... F24F 1/00; F24F 1/0003; F24F 1/02; F24F 1/022; F24F 1/0284; F24F 1/0287;
(Continued)

(56) References Cited

U.S. PATENT DOCUMENTS 2,317,104 A * 4/1943 Moore ..... F24F 1/027 D23/351
2,644,321 A 7/1953 Borgerd
(Continued)

FOREIGN PATENT DOCUMENTS

CN 1502885 A 6/2004
CN 1560520 A 1/2005
(Continued)

OTHER PUBLICATIONS

International Search Report, International Application No. PCT/KR2014/004996, dated Feb. 24, 2015, 2 pages, publisher Korean Intellectual Property Office, Daejeon, Republic of Korea.
(Continued)

*Primary Examiner* — Miguel A Diaz

(57) ABSTRACT

An integrated air conditioner comprises: a housing partitioned into a first housing on the upper side thereof and a second housing on the lower side thereof, wherein the first housing has a first intake port through which external air is introduced thereinto and a first exhaust port through which internal air is exhausted therefrom, and the second housing has a second intake port through which external air is introduced thereinto and a second exhaust port through which internal air is exhausted therefrom; a compressor provided in the interior of the housing to compress a refrigerant; a condenser that is provided on a second fluid channel, which connects the second intake port and the second exhaust port, and condenses the compressed refrigerant, supplied from the compressor, into a liquid phase; an expansion unit that expands the refrigerant, condensed in the condenser, into a low-pressure refrigerant; and an evaporator.

25 Claims, 8 Drawing Sheets

Related U.S. Application Data continuation of application No. 15/315,347, filed as application No. PCT/KR2014/004996 on Jun. 5, 2014, now abandoned.

(51) Int. Cl.

| | |
|---|---|
| ***F24F 1/0323*** | (2019.01) |
| ***F24F 1/04*** | (2011.01) |
| ***F24F 13/20*** | (2006.01) |
| ***F24F 13/22*** | (2006.01) |

(52) U.S. Cl.

CPC ..... *F24F 13/20* (2013.01); *F24F 13/222* (2013.01); *F24F 2013/225* (2013.01)

(58) Field of Classification Search

CPC .... F24F 1/029; F24F 1/03; F24F 1/031; F24F 1/0314; F24F 1/032; F24F 1/0323; F24F 1/0325; F24F 1/0328; F24F 1/03504; F24F 13/20; F24F 13/222; F24F 2013/225; F24F 1/035; F24F 1/04

See application file for complete search history.

(56) References Cited

U.S. PATENT DOCUMENTS

| | | | | |
|---|---|---|---|---|
| 3,018,642 | A | 1/1962 | Lathrop | |
| 3,200,609 | A | 8/1965 | Laing | |
| 3,301,003 | A | 1/1967 | Laing | |
| 4,347,708 | A | 9/1982 | Bussjager | |
| 5,117,652 | A | 6/1992 | Takeuchi et al. | |
| 5,377,503 | A | 1/1995 | Reedy et al. | |
| 5,638,695 | A | 6/1997 | Kamio et al. | |
| 5,884,495 | A | 3/1999 | Powell et al. | |
| 6,218,752 | B1 | 4/2001 | Chang et al. | |
| 8,037,707 | B2 | 10/2011 | Lee et al. | |
| 9,631,834 | B2 | 4/2017 | Uselton et al. | |
| 9,958,172 | B2 | 5/2018 | Uselton et al. | |
| 11,655,999 | B2 * | 5/2023 | Davtyan | F24F 1/032 62/426 |
| 2002/0157415 | A1 | 10/2002 | Liu | |
| 2004/0045304 | A1 | 3/2004 | Park | |
| 2005/0236013 | A1 | 10/2005 | Huston et al. | |
| 2007/0000270 | A1 | 1/2007 | Huang et al. | |
| 2008/0000252 | A1 | 1/2008 | Lee et al. | |
| 2008/0000253 | A1 | 1/2008 | Kim et al. | |
| 2008/0104988 | A1 | 5/2008 | Lee et al. | |
| 2008/0104990 | A1 | 5/2008 | Lee et al. | |
| 2010/0050682 | A1 | 3/2010 | Ariga | |
| 2010/0126198 | A1 | 5/2010 | Holguin | |
| 2010/0130121 | A1 | 5/2010 | Chiu | |
| 2012/0247132 | A1 | 10/2012 | Lakdawala et al. | |
| 2013/0125574 | A1 | 5/2013 | Uselton et al. | |
| 2013/0133351 | A1 | 5/2013 | Kil et al. | |
| 2015/0260422 | A1 | 9/2015 | Baruch | |
| 2015/0267929 | A1 | 9/2015 | Kim et al. | |
| 2016/0131372 | A1 | 5/2016 | Choi et al. | |
| 2016/0231007 | A1 | 8/2016 | Ha et al. | |
| 2017/0007860 | A1 | 1/2017 | Asbra et al. | |
| 2017/0045241 | A1 | 2/2017 | Chiu | |
| 2017/0138617 | A1 | 5/2017 | Kim et al. | |
| 2017/0176027 | A1 | 6/2017 | Eicher et al. | |
| 2017/0176056 | A1 | 6/2017 | Eicher et al. | |
| 2017/0227242 | A1 | 8/2017 | Kimura et al. | |
| 2018/0372367 | A1 | 12/2018 | Carlson et al. | |
| 2018/0372369 | A1 | 12/2018 | DeMonte et al. | |
| 2019/0003732 | A1 | 1/2019 | Seo et al. | |
| 2019/0024909 | A1 | 1/2019 | Lee et al. | |

FOREIGN PATENT DOCUMENTS

| | | | |
|---|---|---|---|
| CN | 2672525 | Y | 1/2005 |
| CN | 1888697 | A | 1/2007 |
| CN | 201779824 | U | 3/2011 |
| CN | 102072679 | A | 5/2011 |
| CN | 202734194 | U | 2/2013 |
| CN | 103134113 | A | 6/2013 |
| EP | 2206977 | A1 | 7/2010 |
| GB | 2111183 | A | 6/1983 |
| JP | 58055631 | A | 4/1983 |
| JP | 59086838 | A | 5/1984 |
| JP | 59122834 | A | 7/1984 |
| JP | 05-240461 | A | 9/1993 |
| JP | 6-69621 | U | 9/1994 |
| JP | 08-061699 | A | 3/1996 |
| JP | H09280608 | A | 10/1997 |
| JP | 2001227769 | A | 8/2001 |
| KR | 20-1998-0028546 | U | 8/1998 |
| KR | 20-1999-0023430 | U | 7/1999 |
| KR | 20-2000-0018462 | U | 10/2000 |
| KR | 10-2002-0054728 | A | 7/2002 |
| KR | 10-0452374 | B1 | 10/2004 |
| KR | 10-0471438 | B1 | 3/2005 |
| KR | 10-0512619 | B1 | 9/2005 |
| KR | 10-2006-0039355 | A | 5/2006 |
| KR | 10-2007-0028884 | A | 3/2007 |
| KR | 10-2008-0041072 | A | 5/2008 |
| KR | 10-2009-0028856 | A | 3/2009 |
| KR | 10-2013-0057618 | A | 6/2013 |
| KR | 10-2014-0133722 | A | 11/2014 |

OTHER PUBLICATIONS

Written Opinion, International Application No. PCT/KR2014/004996, dated Feb. 24, 2015, 9 pages, publisher Korean Intellectual Property Office, Daejeon, Republic of Korea.

Communication from a foreign patent office in a counterpart foreign application, EPO, "Supplementary European Search Report," European Application No. EP 14 89 3973.9, dated Dec. 18, 2017, 8 pages.

China National Intellectual Property Administration, "The First Office Action," Application No. CN201480079573.6, dated Dec. 4, 2018, 30 pages.

Office Action dated Jul. 23, 2019 in connection with Chinese Patent Application No. 201480079573.6, 28 pages.

Office Action dated Jul. 11, 2019 in connection with Korean Patent Application No. 10-2013-0053118, 18 pages.

Office Action dated Jan. 19, 2020 in connection with Chinese Patent Application No. 201480079573.6, 19 pages.

Notice of Rejection dated Jan. 29, 2020 in connection with Korean Patent Application No. 10-2013-0053118, 5 pages.

Kaiyan Chen, "Ventilation Engineering", China University of Mining Press, Nov. 30, 2013, pp. 52-54.

Communication pursuant to Article 94(3) EPC dated Apr. 21, 2020 in connection with European Patent Application No. 14 893 973.9, 4 pages.

Invitation pursuant to Rule 63(1) EPC dated Nov. 24, 2020 in connection with European Application No. 20192421.4, 3 pages.

Office Action dated May 17, 2021 in connection with Chinese Patent Application No. 202010962122.4, 21 pages.

European Search Report dated Apr. 8, 2021 in connection with European Patent Application No. 20 19 2421, 9 pages.

Notice of Patent Allowance dated Jul. 24, 2020 in connection with Korean Patent Application No. 10-2013-0053118, 3 pages.

Office Action dated dated Jan. 21, 2021 in connection with Korean Patent Application No. 10-2020-0138652, 16 pages.

Decision of Rejection dated Jul. 28, 2021 in connection with Korean Patent Application No. 10-2020-0138652, 7 pages.

Notice of Preliminary Rejection dated Sep. 19, 2021 in connection with Korean Patent Application No. 10-2020-0138652, 4 pages.

China National Intellectual Property Administration, PRC, "The Second Office Action" dated Dec. 28, 2021, in connection with Chinese Patent Application No. 202010962122.4, 15 pages.

Korean Intellectual Property Office, "Notice of Patent Allowance" dated Mar. 7, 2022, in connection with Korean Patent Application No. 10-2020-0138652, 4 pages.

Decision of Rejection dated Apr. 25, 2022, in connection with Korean Application No. 202010962122.4, 14 pages.

(56) References Cited

OTHER PUBLICATIONS

European Patent Office, "Communication Pursuant to Article 94(3) EPC," dated Nov. 30, 2022, in connection with European Patent Application No. 20192421.4, 4 pages.
Korean Intellectual Property Office, "Notice of Preliminary Rejection," issued 10-2022-0068792, in connection with Korean Patent Application No. dated Jan. 31, 2023, 20 pages.
Office Action dated Aug. 30, 2023, in connection with Korean Patent Application No. 10-2022-0068792, 8 pages.

* cited by examiner

[Fig. 1]
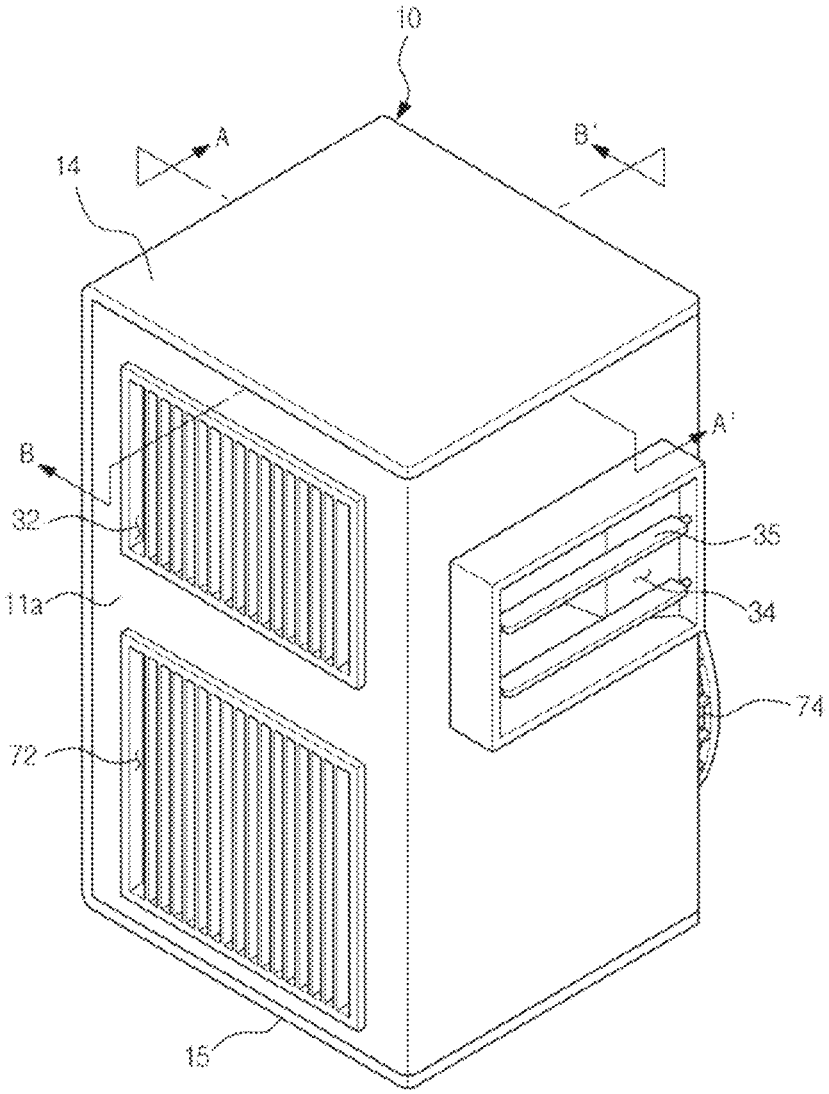

[Fig. 2]
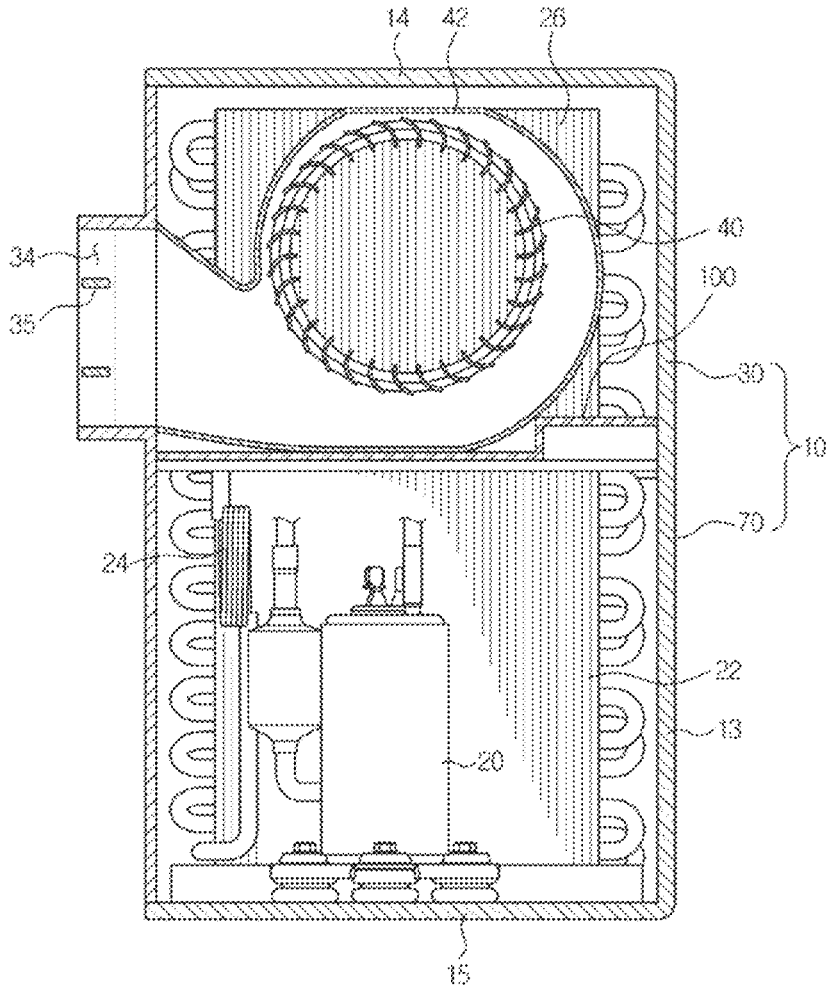

[Fig. 3]
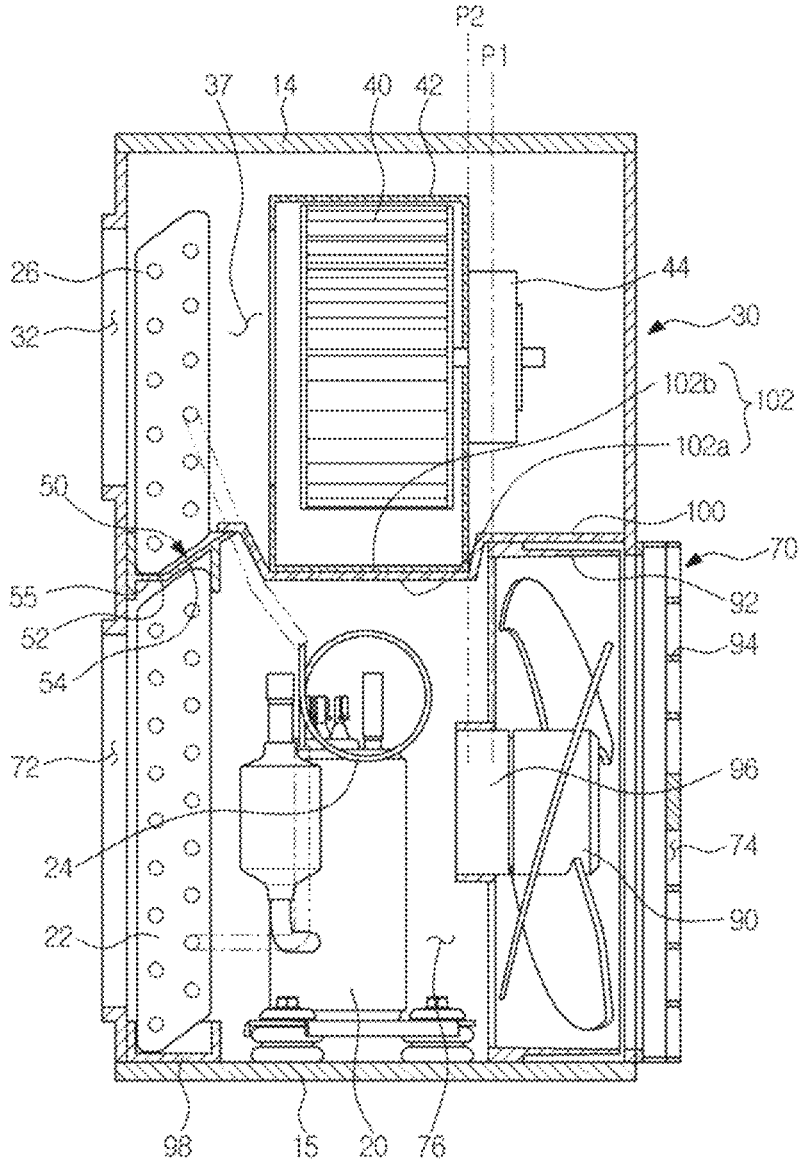

[Fig. 4]
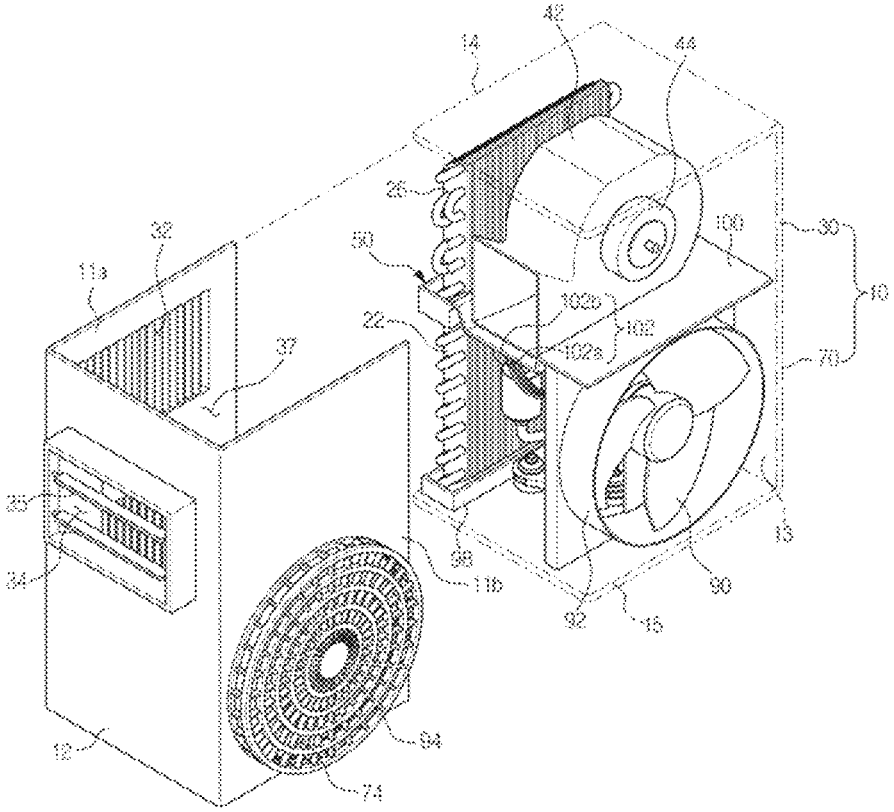

[Fig. 5]
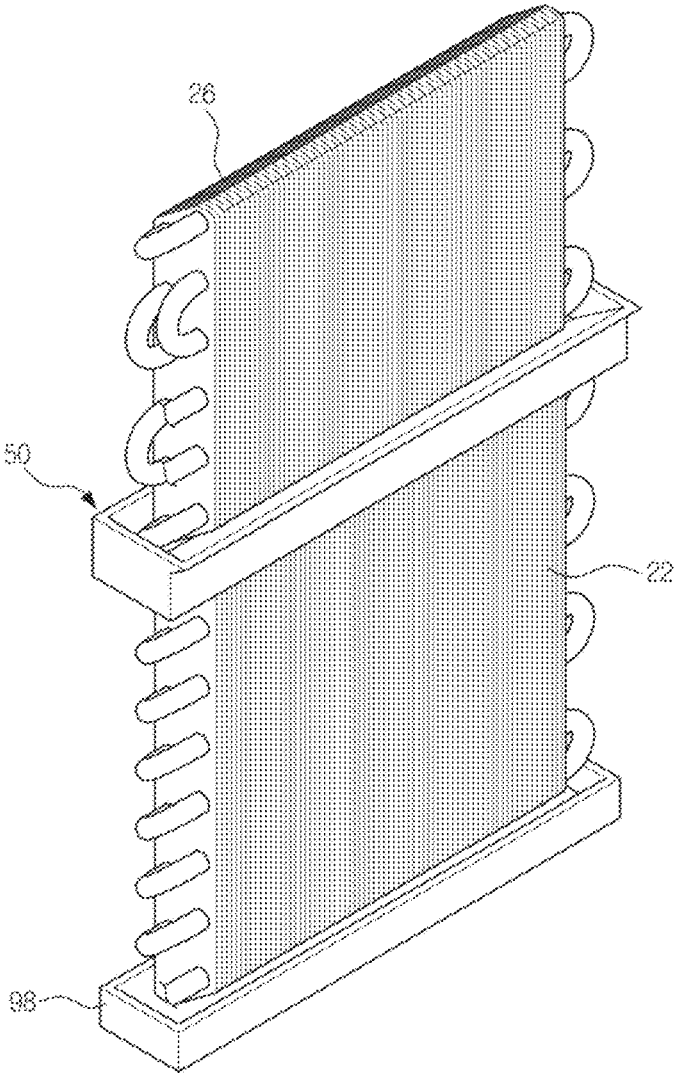
[Fig. 6]
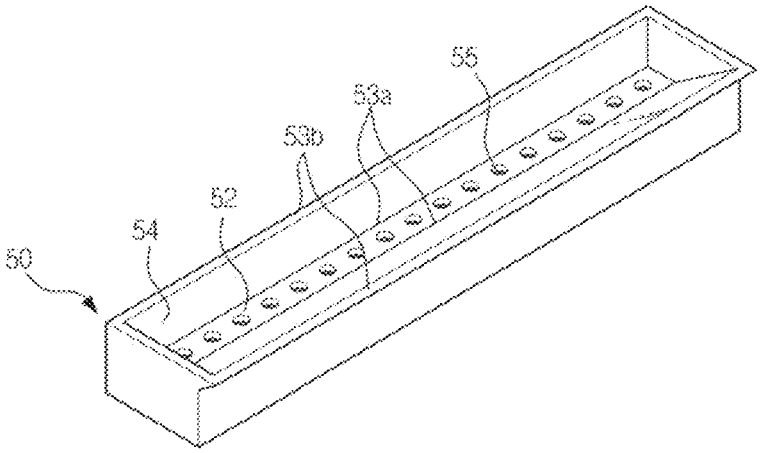

[Fig. 7]
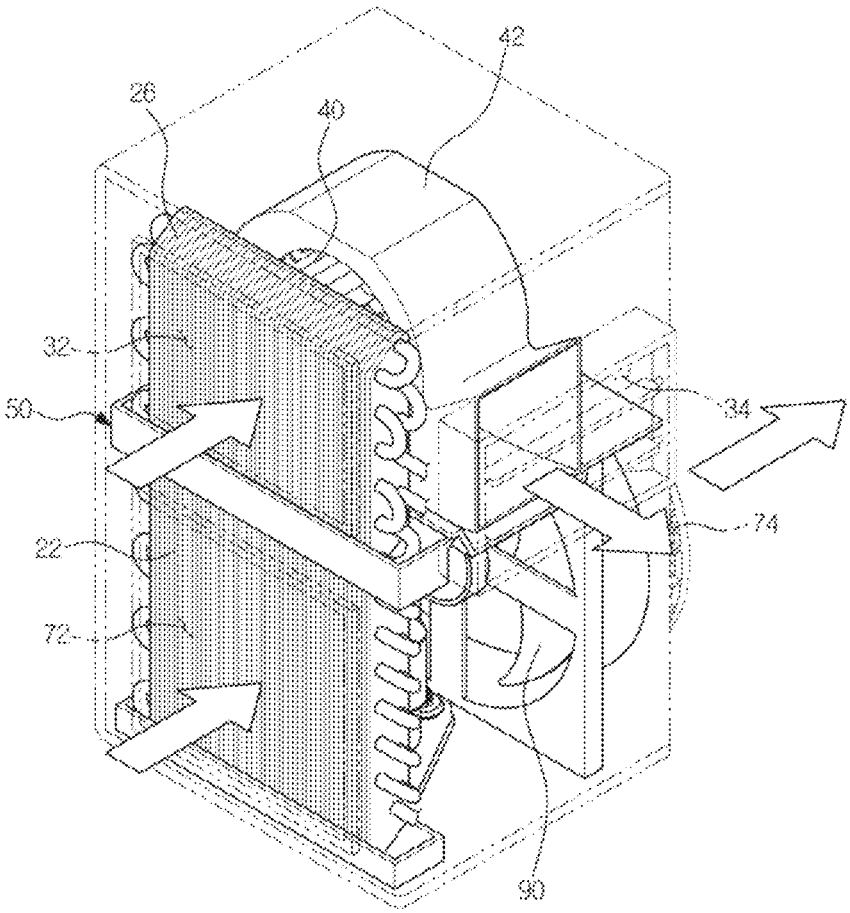

[Fig. 8]
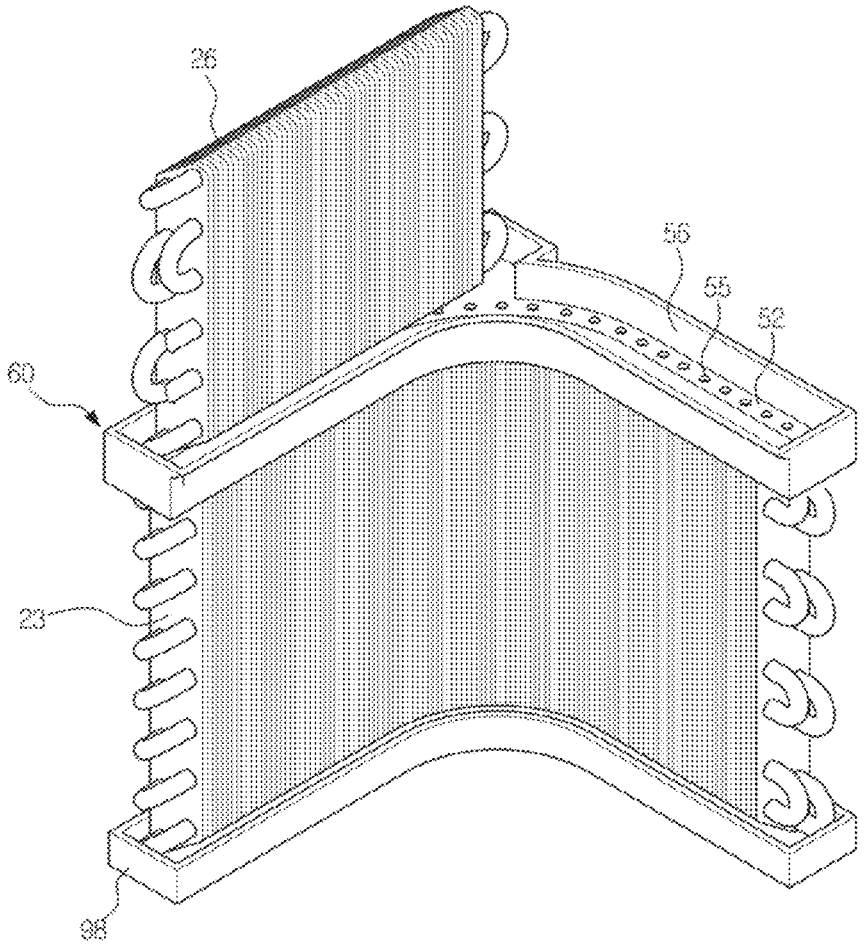
[Fig. 9]
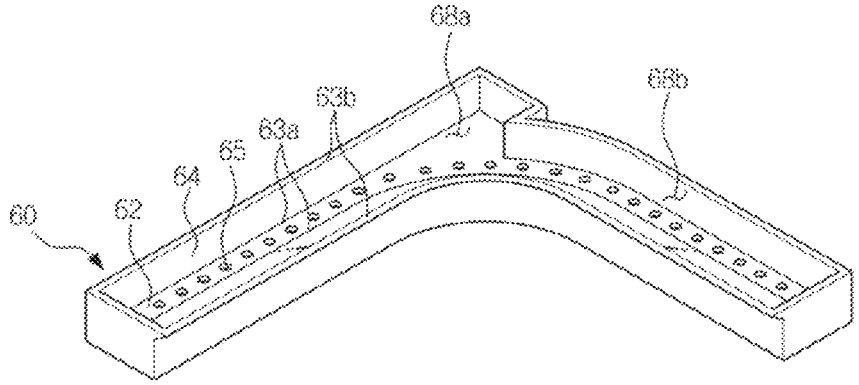

[Fig. 10]
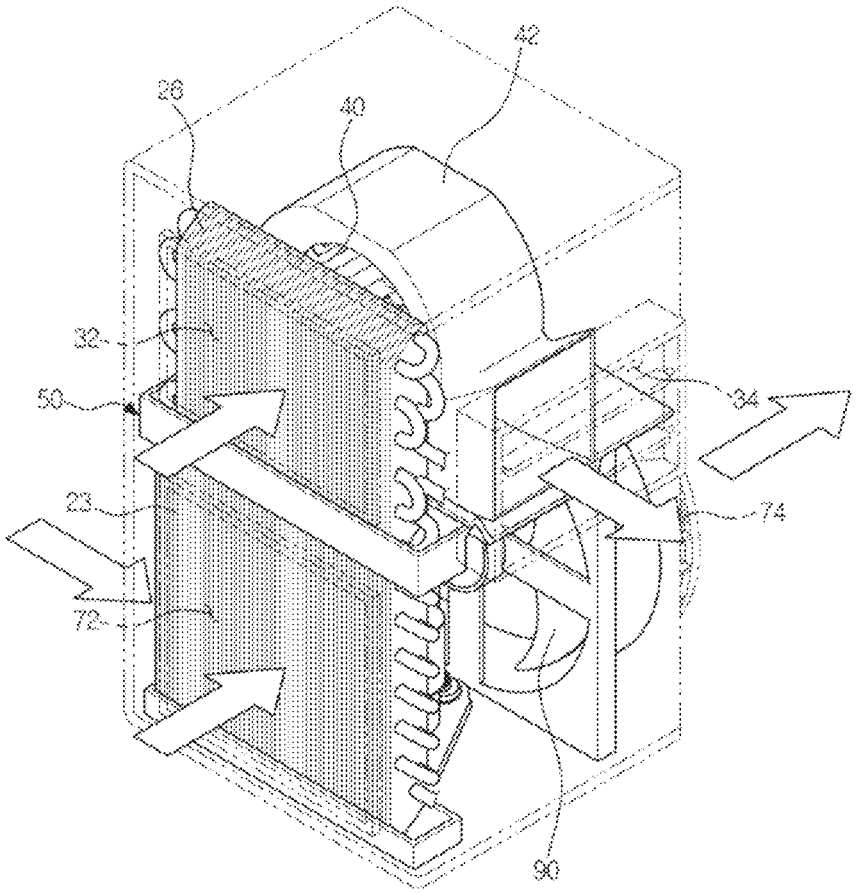

INTEGRATED AIR CONDITIONER

CROSS-REFERENCE TO RELATED APPLICATIONS

The present application is a continuation of U.S. patent application Ser. No. 17/008,285 filed on Aug. 31, 2020, which is a continuation of U.S. patent application Ser. No. 15/315,347 filed on Nov. 30, 2016, which is a 371 of International Patent Application No. PCT/KR2014/004996 filed on Jun. 5, 2014, the disclosures of which are herein incorporated by reference in their entirety.

1. FIELD

The present invention relate to an integrated air conditioner, and more particularly, to an integrated air conditioner in which an outdoor unit and an indoor unit are integrated.

2. DESCRIPTION OF RELATED ART

Generally, an air conditioner is a device which controls temperature, humidity, air flow, a distribution and the like appropriate for activity of a human by using a refrigeration cycle and simultaneously removes dust and the like in air. Main parts which constitute the refrigeration cycle include a compressor, a condenser, an evaporator, and a blower fan.

An air conditioner is referred to as a split-type air conditioner when an indoor unit and an outdoor unit are installed separately, and referred to as an integrated air conditioner when an indoor unit and an outdoor unit are installed in one cabinet.

Generally, even in an integrated air conditioner, an indoor unit is provided toward the indoor side of a wall or a window, and an outdoor unit is provided toward the outdoor side of the wall or the window, wherein the indoor unit and the outdoor unit are disposed across the wall or the window.

Therefore, since such an air conditioner has a large volume and is partly installed in the wall or the window even if it is an integrated air conditioner, it is bad in an aesthetic aspect.

SUMMARY

In accordance with one aspect of the present invention, an integrated air conditioner includes: a housing partitioned into a first housing on an upper side thereof and a second housing on a lower side thereof, a first intake port and a first exhaust port provided in the first housing so that external air flows in and out; a second intake port and a second exhaust port provided in the second housing so that external air flows in and out; an evaporator which evaporates a refrigerant having a low temperature and low pressure on a first fluid channel connecting the first intake port and the first exhaust port and performs heat exchange with surroundings thereof, a compressor provided in the housing to compress the refrigerant from the evaporator; a condenser provided on a second fluid channel connecting the second intake port and the second exhaust port to condense the refrigerant compressed by the compressor into a liquid state; an expansion unit which expands the refrigerant condensed by the condenser into the refrigerant in a low pressure state; and a water storage tray provided between the evaporator and the condenser and configured to store condensate generated from the evaporator and discharge the condensate to the condenser.

The water storage tray may further include a drain hole configured to discharge the stored condensate to the condenser.

The water storage tray may include a first water storage region provided under the evaporator; and a second water storage region provided above the condenser, wherein the second water storage region may be provided with the drain hole.

At least parts of the first intake port and the second intake port may be vertically disposed.

The evaporator and the condenser may be respectively disposed to be adjacent to the first intake port and the second intake port.

The first intake port and the second intake port may be vertically regularly provided at one side of the housing, and the evaporator and the condenser may be respectively provided to be adjacent to the first intake port and the second intake port.

The first exhaust port and the second exhaust port may be provided at different sides in the housing.

The housing may include: a left panel in which the first intake port and the second intake port are provided; a right panel in which the second exhaust port is provided; and a front panel in which the first exhaust port is provided.

The integrated air conditioner may further include an upper blower fan provided on the first fluid channel and configured to discharge internal air.

The integrated air conditioner may further include a partition provided between the first housing and the second housing and configured to partition the first housing and the second housing.

A region where the upper blower fan is positioned in the partition may include a concave lower side.

The compressor may be provided between the condenser and the second exhaust port on the second fluid channel.

The expansion unit may be formed with a capillary tube.

In accordance with another aspect of the present invention, an integrated air conditioner includes: a housing partitioned into a first housing on an upper side thereof and a second housing on a lower side thereof; a first intake port through which external air flows in and a first exhaust port through which internal air is discharged, which are provided in the first housing; a second intake port through which external air flows in and a second exhaust port through which internal air is discharged, which are provided in the second housing; a first blower fan provided on a first fluid channel which connects the first intake port and the first exhaust port, and a second blower fan provided on a second fluid channel which connects the second intake port and the second exhaust port; a partition which partitions the first housing and the second housing; and a seating portion which includes a convex portion whose outer surface is formed convexly as compared with a bottom surface of the partition, and a concave portion in which a rear surface of the convex portion is formed concavely as compared with a top surface of the partition, wherein the first blower fan is seated on the concave portion, and the second blower fan is provided on a side of the convex portion.

The integrated air conditioner may further includes: a compressor provided in the housing and configured to compress a refrigerant; a condenser provided on the second fluid channel and configured to condense the refrigerant compressed by the compressor into a liquid state; an expansion unit configured to expand the refrigerant condensed by the condenser into the refrigerant in a low pressure state; and an evaporator provided on the first fluid channel to correspond to an upper end of the condenser and configured to return the refrigerant having a low temperature and low pressure from the expansion unit to the compressor.

The housing may include: a left panel in which the first intake port and the second intake port are provided; a right panel in which the second exhaust port is provided; and a front panel in which the first exhaust port is provided.

The first blower fan may include a centrifugal fan.

The second blower fan may include an axial fan.

At least parts of the first intake port and the second intake port may be vertically provided, and the evaporator and the condenser may be respectively provided adjacent to the first intake port and the second intake port.

The integrated air conditioner may include a water storage tray provided between the evaporator and the condenser to store condensate generated from the evaporator and discharge the condensate to the condenser.

The water storage tray may further include a drain hole configured to discharge a stored condensate to the condenser.

The water storage tray may include: a first water storage region provided under the evaporator; and a second water storage region provided above the condenser, wherein the second water storage region may be provided with the drain hole.

In accordance with still another aspect of the present invention, an integrated air conditioner includes: a housing partitioned into a first housing on an upper side thereof and a second housing on a lower side thereof, a compressor provided in the housing and configured to compress a refrigerant; a condenser provided in the second housing and configured to compress the refrigerant compressed by the compressor into a liquid state; a capillary tube which expands the refrigerant compressed by the condenser into the refrigerant in a low pressure state; an evaporator provided in the second housing and configured to return the refrigerant expanded by the capillary tube to the compressor; a first intake port through which external air flows in and a first exhaust port through which internal cold air is discharged, which are provided in the first housing; and a second intake port, through which external air flows in, provided under the first intake port, and a second exhaust port through which internal warm air flows out, which are provided in the second housing, wherein the first exhaust port and the second exhaust port are separately provided in a lateral direction.

The housing may include: a left panel in which the first intake port and the second intake port are provided; a right panel provided to be apart from and parallel to the left panel; and a front panel provided between the left panel and the right panel.

The first exhaust port may be provided in the front panel, and the second exhaust port may be provided in the right panel.

At least parts of the first intake port and the second intake port may be vertically disposed.

The evaporator and the condenser may be respectively disposed adjacent to the first intake port and the second intake port.

In accordance with yet another aspect of the present invention, an integrated air conditioner include: a housing partitioned into a first housing and a second housing; a compressor provided in the housing and configured to compress a refrigerant; a condenser provided in the second housing and configured to condense the refrigerant compressed by the compressor into a liquid state; an expansion unit which expands the refrigerant condensed by the condenser into the refrigerant in a low pressure state; and an evaporator provided in the first housing to correspond to an upper end of the condenser and configured to return the refrigerant having a low temperature and low pressure from the expansion unit to the compressor, wherein the condenser and the evaporator are vertically and regularly provided at at least one side of the housing.

In accordance with yet another aspect of the present invention, an integrated air conditioner comprising: a housing partitioned into a first housing and a second housing; a compressor provided in the housing and configured to compress a refrigerant; a condenser provided in the second housing and configured to condense the refrigerant compressed by the compressor into a liquid state; an expansion unit which expands the refrigerant condensed by the condenser into the refrigerant in a low pressure state; an evaporator provided in the first housing to correspond to an upper end of the condenser and configured to return the refrigerant having a low temperature and low pressure from the expansion unit to the compressor; and a water storage tray provided to store condensate generated from the evaporator and discharge the condensate to the condenser.

The integrated air conditioner according to the present invention includes an improved structure to be capable of miniaturization and to be installed easily.

In addition, the integrated air conditioner is capable of moving and thus changing the location of the integrated air conditioner as needed, that is, portable and thus convenient.

BRIEF DESCRIPTION OF THE DRAWINGS

FIG. 1 is a perspective view illustrating an integrated air conditioner according to one embodiment of the present invention.

FIG. 2 is a cross-sectional view taken along line A-A' of FIG. 1.

FIG. 3 is a cross-sectional view taken along line B-B' of FIG. 1.

FIG. 4 is a perspective view illustrating an internal portion of the integrated air conditioner according to one embodiment of the present invention.

FIG. 5 is a perspective view illustrating a heat exchanger and a water storage tray according to one embodiment of the present invention.

FIG. 6 is a perspective view illustrating the water storage tray according to one embodiment of the present invention.

FIG. 7 is a view which relates to an air flow of the integrated air conditioner according to one embodiment of the present invention.

FIG. 8 is a perspective view illustrating a heat exchanger and a water storage tray according to another embodiment of the present invention.

FIG. 9 is a perspective view illustrating the water storage tray according to another embodiment of the present invention.

FIG. 10 is a view which relates to an air flow of the integrated air conditioner according to another embodiment of the present invention.

DETAILED DESCRIPTION

Hereinafter, embodiments of the present invention will be described in detail with reference to the following drawings.

FIG. 1 is a perspective view illustrating an integrated air conditioner according to one embodiment of the present invention, FIG. 2 is a cross-sectional view taken along line A-A' of FIG. 1, FIG. 3 is a cross-sectional view taken along line B-B' of FIG. 1, and FIG. 4 is a perspective view illustrating an internal portion of the integrated air conditioner according to one embodiment of the present invention.

A housing 10 includes a left panel 11*a* and a right panel 11*b* which form left and right sides, a front panel 12, a rear panel 13, a top panel 14, and a bottom panel 15.

The housing 10 may include an intake port through which air inflows from the outside and an exhaust port through which the internal air is discharged.

The housing 10 may include a first housing 30 on an upper side thereof and a second housing 70 at a lower side, and a partition 100 may be provided between the first housing 30 and the second housing 70 to prevent an air flow between the first housing 30 and the second housing 70.

The first housing 30 may serve as an indoor unit of a cooler in a split-type air conditioner and include an evaporator 26 and a first blower fan 40. The second housing 70 may serve as an outdoor unit of the cooler in the split-type air conditioner and include a condenser 22 and a second blower fan 90. However, the present invention is not limited thereto, and the first housing 30 may also serve as an outdoor unit of a heater and the second housing 70 may also serve as an indoor unit of the heater.

A first intake port 32 through which air inflows from the outside and a first exhaust port 34 through which the internal air is discharged are provided in the first housing 30, and a second intake port 72 through which air inflows from the outside and a second exhaust port 74 through which the internal air is discharged are provided in the second housing 70.

In the embodiment of the present invention, even though the first intake port 32 and the second intake port 72 are vertically provided in the left panel 11*a*, the arrangement may also be different from the above description according to an internal arrangement of components.

In the embodiment of the present invention, even though the first exhaust port 34 and the second exhaust port 74 are respectively provided at the front panel 12 and the right panel 11*b*, the arrangement may also be different from the above description according to an internal arrangement of components.

The compressor 20 compresses a refrigerant to have a high temperature and a high pressure and discharges the refrigerant, and the compressed refrigerant flows into the condenser 22. The condenser 22 condenses the refrigerant compressed by the compressor 20 into a liquid state. Heat is emitted to the outside through a condensing process.

An expansion unit 24 expands the liquid refrigerant having a high temperature and high pressure, which is condensed in the condenser 22, to become a liquid refrigerant in a low pressure state, and the evaporator 26 achieves a refrigeration effect by evaporating the refrigerant expanded by the expansion unit 24 and performing a heat exchange with an object to be cooled using the latent heat from the evaporation of the refrigerant and performs a function of returning the refrigerant having a low temperature and low pressure to the compressor 20. An air temperature of an indoor space may be adjusted using such a cycle.

A blower fan may include the first blower fan 40 provided on a first fluid channel 37 of the first housing 30 and the second blower fan 90 provided on a second fluid channel 76 of the second housing 70.

In the embodiment of the present invention, since the first intake port 32 and the first exhaust port 34 are disposed perpendicular to each other, a centrifugal fan may be used for the first blower fan 40. Accordingly, the temperature of air introduced from the outside through the first intake port 32 formed in the left panel 11*a* may decrease while flowing through the evaporator 26, and the air may be discharged to the first exhaust port 34 formed in the front panel 12 through the first blower fan 40. The air discharged by the first blower fan 40 may be guided by a first blower fan guide 42 which surrounds the first blower fan 40 and may be discharged through the first exhaust port 34. The first blower fan 40 may be operated by a first motor 44 provided on a rotation shaft.

At least one blade 35 for guiding the discharged internal air may be provided in the first exhaust port 34.

In the embodiment of the present invention, since the second intake port 72 and the second exhaust port 74 are disposed to face each other, an axial fan may be used for the second blower fan 90. Accordingly, the temperature of air which inflows from the outside through the second intake port 72 formed in the left panel 11*a* may increase while the air flows through the condenser 22, and the air may be discharged through the second exhaust port 74 formed in the right panel 11*b* using the second blower fan 90. The air discharged by the second blower fan 90 may be guided by a bell mouth 92 which surrounds the second blower fan 90 and may be discharged through the second exhaust port 74. The second blower fan 90 may be operated by a second motor 96 provided on a rotation axis. Since a fan guard 94 is provided at an outside of the bell mouth 92, the fan guard 94 protects the second blower fan 90 and guides the air discharged by the second blower fan 90 to the outside.

In the embodiment of the present invention, even though the centrifugal fan and the axial fan are used for the blower fan, the first blower fan 40 and second blower fan 90 may be different types of fans according to directions of the exhaust ports. For example, the first exhaust port 34 may be provided in the right panel 11*b* and the first blower fan 40 may also include the axial fan. In addition, the second exhaust port 74 may be provided in the front panel 12, and the second blower fan 90 may also include the centrifugal fan.

The partition 100 which partitions the first housing 30 and the second housing 70 may be provided therebetween. The partition 100 may be provided to seal a lower portion of the first housing 30 and an upper portion of the second housing 70 so that internal air does not flow between the first housing 30 and the second housing 70.

A seating portion 102 formed to protrude toward the second housing 70 may be provided on the partition 100 so that the first blower fan 40 in the first housing 30 is seated. The seating portion 102 may be convexly formed on the first housing 30 and may be concavely formed on the second housing 70. Since the height of the first blower fan 40 in the first housing 30 may be decreased using the above-described configuration, the entire height of the integrated air conditioner 1 may be decreased.

The seating portion 102 may include a convex portion 102*a* whose outside surface is convexly formed with respect to a bottom surface of the partition 100 and a concave portion 102*b* in which a rear surface of the convex portion 102*a* is concavely formed with respect to a top surface of the partition 100. Since the first blower fan 40 is seated on the concave portion 102*b* and the second blower fan 90 is provided on a side surface of the convex portion 102*a*, the first blower fan 40 and the second blower fan 90 are not vertically disposed. Using the above-described structure, even when the fan blade of the blower fan is large, the first blower fan 40 and the second blower fan 90 do not interfere with each other, and thus the integrated air conditioner 1 may be miniaturized.

That is, when an imaginary surface including a rear surface of the first blower fan 40 refers to a first reference surface P1, a front surface of the second blower fan 90 may be disposed at the same surface of the first reference surface P1 or disposed at a rear portion thereof. On the contrary, when an imaginary surface including the front surface of the second blower fan 90 refers to a second reference surface P2, the rear surface of the first blower fan 40 may be disposed at the same surface of the second reference surface P2 or disposed at a front portion thereof. In addition, the first blower fan 40 and the second blower fan 90 may be provided so that the first reference surface P1 is disposed at a rear portion of the second reference surface P2.

Even though the compressor 20 may be provided in the housing 10, in the embodiment of the present invention, the compressor 20 is provided on the second fluid channel 76. Specifically, the compressor 20 is provided between the condenser 22 and the second blower fan 90 on the second fluid channel 76, and thus, heat generated by the compressor 20 may be decreased by the second blower fan 90.

The expansion unit 24 which may be disposed between the condenser 22 and the evaporator 26 as described above may perform a function of expanding a liquid refrigerant having a high temperature and high pressure, which is condensed by the condenser 22, to become a liquid refrigerant in a low pressure state and may be formed to have a capillary tube in the embodiment of the present invention. In addition, the expansion unit 24 may be formed to pass the first housing 30 and the second housing 70.

The second fluid channel 76 which is a fluid channel of air which flows through the second housing 70 is provided between the second intake port 72 and the second exhaust port 74, and the condenser 22 is provided on the second fluid channel 76. Specifically, the condenser 22 may be provided on the second fluid channel 76 to be adjacent to the second intake port 72.

The first fluid channel 37 which is fluid channel of air which flows through the first housing 30 is provided between the first intake port 32 and the first exhaust port 34, and the evaporator 26 is provided on the first fluid channel 37. Specifically, the evaporator 26 may be provided on the first fluid channel 37 to be adjacent to the first intake port 32.

Since the first intake port 32 and the second intake port 72 may be provided to respectively correspond the evaporator 26 and the condenser 22 and the evaporator 26 and the condenser 22 are disposed adjacent to the left panel 11*a* in the embodiment of the present invention, the first intake port 32 and the second intake port 72 may also be provided on the left panel 11*a*. However, the present invention is not limited thereto, and when the evaporator 26 and the condenser 22 extend along and are formed adjacent to another surface, the first intake port 32 and the second intake port 72 may also be formed on another surface corresponding to the evaporator 26 and the condenser 22.

At least parts of the evaporator 26 and the condenser 22 may be provided to be vertically disposed.

Condensate is generated on a surface of the evaporator 26 while indoor air exchanges heat with the evaporator 26. The generated condensate may be dropped onto a surface of the condenser 22 to improve an efficiency of heat exchange of the condenser 22, and simultaneously, the condensate generated by the evaporator 26 may not be discharged additionally.

A water storage tray 50 is provided under the evaporator 26 to collect the condensate and spray the condensate to the condenser 22.

FIG. 5 is a perspective view illustrating a heat exchanger and a water storage tray according to one embodiment of the present invention, and FIG. 6 is a perspective view illustrating the water storage tray according to one embodiment of the present invention.

The water storage tray 50 may include an opening facing the evaporator 26, a tray bottom surface 52 corresponding to a heat exchanger, and a tray flange 54 formed to extend upward from an end of the tray bottom surface 52.

Drain holes are provided in the tray bottom surface 52 to correspond to a layout of an upper portion of the condenser 22. Since the condensate wets the surface of the condenser 22 by being drained through the drain holes while being stored in the water storage tray 50, the efficiency of heat exchange of the condenser 22 may be improved.

At least a part of the tray bottom surface 52 includes an inclined surface, and the tray bottom surface 52 includes a first portion 53*a* which is a lower end of one side of the inclined surface and a second portion 53*b* which is disposed higher than the first portion 53*a* and an upper end of one side of the inclined surface. The drain holes 55 may be disposed in the first portion 53*a*. Condensate may flow along the inclined surface and not stay and thus may be discharged through the drain holes 55 using the above-described configuration.

The tray bottom surface 52 may be formed parallel to the evaporator 26 disposed thereon, and one or more drain holes 55 may be provided in the tray bottom surface 52 to be parallel to a layout of the condenser 22.

A drain tray 98 is provided under the condenser 22 to store the remaining condensate after the condensate is discharged from the water storage tray 50 and decreased at the surface of the condenser 22.

Hereinafter, an operation of the integrated air conditioner including the above-described configuration according to one embodiment of the present invention will be described in detail.

FIG. 7 is a view which relates to an air flow of the integrated air conditioner according to one embodiment of the present invention.

When the air conditioner 1 operates, a refrigerant moves through a compressor 20, a condenser 22, an expansion unit 24, and an evaporator 26.

In the above-described process, a condensate is generated on the surface of the evaporator 26 due to the external air passing through. The condensate is stored in the water storage tray 50, drained through the drain hole 55, and evaporated from the surface of the condenser 22, thereby improving the efficiency of the heat exchange of the condenser 22.

From an air conditioning perspective, since the evaporator 26 and the condenser 22 are vertically disposed on one side surface of the housing 10 of the air conditioner 1, the first intake port 32 which guides external air to the evaporator 26 and the second intake port 72 which guides the external air to the condenser 22 are provided on the same side in the housing 10.

Internal air, which passed through the evaporator 26 and thus had a lower temperature than an external air, is discharged to the first exhaust port 34 of the front panel 12 through the first blower fan 40, and internal air, which passed through the condenser 22 and thus had a higher temperature than an external air, is discharged to the second exhaust port 74 of the right panel 11*b* through the second blower fan 90.

Since the first exhaust port 34 and the second exhaust port 74 are provided separately and laterally and provided at different sides of the housing, a cooling influence due to an interference with each other may be decreased, and thus, cooling efficiency or heating efficiency may be improved.

FIG. 8 is a perspective view illustrating a heat exchanger and a water storage tray according to another embodiment of the present invention, and FIG. 9 is a perspective view illustrating the water storage tray according to another embodiment of the present invention.

In another embodiment of the present invention, the same configuration as that described with one embodiment of the present invention or a repeating configuration will be omitted.

In another embodiment of the present invention, a condenser 22 may be provided on two sides of a second housing 70. Even though the condenser 22 is provided on the two sides in the present embodiment, on the contrary, an evaporator 26 may be formed as in the present embodiment, and the two components may also be formed as in the present embodiment.

As the condenser 22 is provided on the two sides, a second intake port 82 may also be provided on two sides in the second housing 70 along the condenser 22. A second fluid channel 86 which connects the second intake port 82 and a second exhaust port 84 is formed on the second intake port 82 and the second exhaust port 84.

A water storage tray 60 may include an opening facing the evaporator 26, a tray bottom surface 62 corresponding to a heat exchanger, and a tray flange 64 formed to extend upward from an end of the tray bottom surface 62.

A drain hole 65 is provided in the tray bottom surface 62 to correspond to a shape of an upper portion of the condenser 22. Since condensate wets a surface of the condenser 22 by being drained through the drain hole 65 while being stored in the water storage tray 60, the efficiency of heat exchange of the condenser 22 may be improved.

At least a part of the tray bottom surface 62 includes an inclined surface, and the tray bottom surface 62 includes a first portion 63*a* which is a lower end of one side of the inclined surface, and a second portion 63*b* which is disposed at a higher level than the first portion 63*a* and an upper end of one side of the inclined surface. The drain hole 65 may be disposed in the first portion 63*a*. Condensate may flow along the inclined surface and not stay and may be discharged through the drain hole 65 using the above-described structure.

The water storage tray 60 includes a first water storage region 68*a* provided to correspond to a lower portion of the evaporator 26 and a second water storage region 68*b* provided to correspond to an upper portion of the condenser 22.

Since at least parts of the evaporator 26 and the condenser 22 are provided to be matched vertically, at least a part of the first water storage region 68*a* may overlap the second water storage region 68*b*.

The drain hole 65 is provided in the tray bottom surface 62 of the second water storage region 68*b* to discharge condensate along a layout of the condenser 22.

Hereinafter, an operation of the integrated air conditioner 1 including the above-described configuration according to another embodiment of the present invention will be described.

FIG. 10 is a view which relates to an air flow of the integrated air conditioner according to another embodiment of the present invention. In the embodiment, a description of an operation of a configuration identical to that described with one embodiment of the present invention will be omitted.

When the air conditioner 1 operates, a refrigerant moves through the compressor 20, the condenser 22, the expansion unit 24, and the evaporator 26.

In this process, a condensate is generated on a surface of the evaporator 26 due to external air passing through the evaporator 26. The condensate is stored in the water storage tray 60, and specifically, is stored in the first water storage region 68*a*. Since at least a part of the first water storage region 68*a* overlaps the second water storage region 68*b*, the condensate is stored in the first water storage region 68*a* and the second water storage region 68*b* in equal amounts.

The stored condensate is discharged to an upper portion of the condenser 22 through the drain hole 65 provided in the second water storage region 68*b*, thereby improving the efficiency of heat exchange of the condenser 22.

In the above, specific embodiments of the present invention are illustrated and described. However, the present invention is not limited to the embodiments described above, and it will be understood by those skilled in the art that various modifications and alternations may be made without departing from the spirit and scope described in the appended claims.

What is claimed is:

1. An integrated air conditioner comprising:

a housing partitioned into a first housing on an upper side of the housing and a second housing on a lower side of the housing;

a first intake port provided in the first housing and configured to allow air to flow in;

a first exhaust port provided in the first housing and configured to discharge air;

a second intake port provided in the second housing and configured to allow air to flow in;

a second exhaust port provided in the second housing and configured to discharge air;

an evaporator provided on a first fluid channel connecting the first intake port and the first exhaust port to heat exchange the air on the first fluid channel;

a condenser provided on a second fluid channel connecting the second intake port and the second exhaust port to heat exchange the air on the second fluid channel; and a water storage tray including a plurality of drain holes disposed along the condenser, wherein the water storage tray supports the evaporator such that the evaporator is disposed above the plurality of drain holes, wherein the plurality of drain holes is disposed along a first direction passing through the first intake port and extending in a straight line, and wherein a portion of the condenser is extended along the first direction so that condensate water passing through the plurality of drain holes is directly discharged to the portion of the condenser.

2. The integrated air conditioner of claim 1, wherein the first intake port and the second intake port have at least a part thereof vertically arranged.

3. The integrated air conditioner of claim 1, wherein a drain hole of the plurality of drain holes is formed to discharge stored condensate water to the condenser.

4. The integrated air conditioner of claim 1, wherein the evaporator includes a part extended in a direction parallel with a first side of the first housing, and the condenser includes a part extended in a direction crossing the direction in which the evaporator is extended.

5. The integrated air conditioner of claim 4, wherein the water storage tray directly receives the condensate water generated from the evaporator and discharges, through the plurality of drain holes, the condensate water directly to the part of the condenser.

6. The integrated air conditioner of claim 1, wherein the first intake port is configured to allow air to flow in through a first side of the first housing, and the second intake port is extended from a first side of the second housing provided below the first side of the first housing to a second side of the second housing.

7. The integrated air conditioner of claim 6, wherein the water storage tray is formed as a single integral part.

8. The integrated air conditioner of claim 1, wherein the second intake port is extended from a first side of the second housing to a second side of the second housing arranged perpendicular to the first side of the second housing.

9. The integrated air conditioner of claim 8, further comprising a drain tray provided below the condenser to collect condensate falling from the condenser, the drain tray including a part disposed in parallel with the second side of the second housing.

10. The integrated air conditioner of claim 8, wherein:

an upper blower fan is provided on the first fluid channel, and a lower blower fan is provided on the second fluid channel.

11. The integrated air conditioner of claim 10, wherein the lower blower fan has an inlet through which air flows in, the inlet disposed to be opposite to the condenser.

12. The integrated air conditioner of claim 10, wherein the lower blower fan has an inlet through which air flows in, the inlet disposed to be opposite to at least one of the first side of the second housing or the second side of the second housing.

13. The integrated air conditioner of claim 10, further comprising:

a partition configured to partition the housing to the first housing and the second housing; and a seating portion formed on the partition to be recessed toward the second housing, the seating portion including a convex portion whose outer surface is formed convexly as compared with a bottom surface of the partition, and a concave portion in which a rear surface of the convex portion is formed concavely as compared with a top surface of the partition.

14. An integrated air conditioner comprising:

a housing including a first panel portion and a second panel portion;

a first intake port configured to allow air to flow in through the first panel portion of the housing;

a first exhaust port configured to discharge air flowing into the housing through the first intake port;

a second intake port extended from the first panel portion of the housing to the second panel portion of the housing, and configured to allow air to flow into the housing through both of the first panel portion and the second panel portion of the housing;

a second exhaust port configured to discharge air, flowing into the housing through the second intake port;

an evaporator provided on a first fluid channel connecting the first intake port and the first exhaust port to heat exchange the air on the first fluid channel;

a condenser provided on a second fluid channel connecting the second intake port and the second exhaust port to heat exchange the air on the second fluid channel; and a water storage tray including a plurality of drain holes disposed along the condenser and supporting the evaporator such that the evaporator is disposed above the plurality of drain holes, wherein the plurality of drain holes is disposed along a first direction from the second exhaust port to the second intake port facing the second exhaust port, and wherein a portion of the condenser is extended along the first direction so that condensate water passing through the plurality of drain holes is directly discharged to the portion of the condenser.

15. The integrated air conditioner of claim 14, wherein the first intake port and the second intake port have at least a part thereof vertically arranged.

16. The integrated air conditioner of claim 14, wherein the evaporator includes a part extended in a direction parallel with the first panel portion of the housing, and the condenser includes a part extended in a direction crossing the direction in which the evaporator is extended.

17. The integrated air conditioner of claim 14, further comprising a drain tray provided below the condenser to collect condensate falling from the condenser, the drain tray including a part disposed in parallel with the second panel portion of the housing.

18. The integrated air conditioner of claim 14, wherein the second exhaust port is formed in a side surface of the housing arranged perpendicular to the second panel portion.

19. The integrated air conditioner of claim 14, wherein the water storage tray directly receives the condensate water generated from the evaporator and discharges, through the plurality of drain holes, the condensate water directly to the portion of the condenser arranged to face the second panel portion of the housing.

20. The integrated air conditioner of claim 19, wherein the water storage tray is formed as a single integral part.

21. The integrated air conditioner of claim 14, wherein:

an upper blower fan is provided on the first fluid channel to discharge internal air, and a lower blower fan is provided on the second fluid channel that connects the second intake port to the second exhaust port.

22. The integrated air conditioner of claim 21, wherein the lower blower fan has an inlet through which air flows in, the inlet disposed to be opposite to the condenser.

23. The integrated air conditioner of claim 21, wherein the lower blower fan has an inlet through which air flows in, the inlet disposed to be opposite to at least one of the first panel portion or the second panel portion.

24. The integrated air conditioner of claim 21, further comprising:

a partition configured to partition the housing to the first panel portion and the second panel portion, wherein a part of the partition on which the upper blower fan is provided is concavely formed.

25. The integrated air conditioner of claim 21, further comprising:

a partition configured to partition an inside of the housing to an upper portion and a lower portion; and a seating portion formed on the partition to be recessed toward the lower portion of the partitioned inside of the housing, the seating portion including a convex portion whose outer surface is formed convexly as compared with a bottom surface of the partition, and a concave portion in which a rear surface of the convex portion is formed concavely as compared with a top surface of the partition.

* * * * *